US007992240B2

(12) United States Patent
Gladney

(10) Patent No.: US 7,992,240 B2
(45) Date of Patent: Aug. 9, 2011

(54) MATTRESS WITH PIVOTING MEMBER ATTACHED TO ADJUSTABLE BED FRAME

(75) Inventor: Richard F. Gladney, Fairburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/675,201

(22) Filed: Sep. 29, 2003

(65) Prior Publication Data

US 2005/0039265 A1 Feb. 24, 2005

Related U.S. Application Data

(60) Provisional application No. 60/414,189, filed on Sep. 27, 2002.

(51) Int. Cl.
*A47C 19/02* (2006.01)
*A47C 17/86* (2006.01)
*A47C 23/043* (2006.01)

(52) U.S. Cl. ..... 5/618; 5/610; 5/617; 5/411; 5/723

(58) Field of Classification Search ..... 5/610, 608, 5/617, 57.1, 691, 722, 723, 690, 694, 703, 5/737, 509.1, 607, 411, 618
See application file for complete search history.

(56) References Cited

U.S. PATENT DOCUMENTS 525,959 A * 9/1894 Martin ..... 5/610
540,112 A * 5/1895 Rude ..... 5/722
1,060,294 A * 4/1913 Snouffer ..... 441/128
1,103,906 A * 7/1914 Palmer ..... 5/617
1,256,752 A * 2/1918 Wersel, Jr. ..... 5/617
1,270,737 A * 6/1918 Hyatt ..... 5/610
1,642,140 A * 9/1927 Cane et al. ..... 5/696
1,842,873 A * 1/1932 Leeking ..... 5/411
2,033,841 A * 3/1936 Maddux ..... 5/737
2,387,357 A * 10/1945 Rogerson ..... 5/617
2,634,426 A * 4/1953 Anderson ..... 5/1
2,696,207 A * 12/1954 Bushnell ..... 601/91
2,701,884 A * 2/1955 Young ..... 5/411
2,721,339 A * 10/1955 Johnson ..... 5/722
2,860,937 A * 11/1958 Einstein et al. ..... 5/723
2,932,831 A * 4/1960 Keathley, Sr. et al. ..... 5/617
3,538,521 A * 11/1970 Basner ..... 5/691

(Continued)

FOREIGN PATENT DOCUMENTS

EP 1 201 164 A1 5/2002

*Primary Examiner* — Michael Safavi
(74) *Attorney, Agent, or Firm* — Cantor Colburn LLP

(57) ABSTRACT

Mattresses that have a point of attachment to an adjustable bed frame that provides a pivot point about which the mattress can pivot when rising to an inclined position. In one embodiment the mattress has a pivoting member extending transversely through the mattress and provides a pivot point about which one portion of the mattress can pivot in relation to another portion of the mattress. By placing the member about midway through the mattress, one half of the mattress can pivot relative to the other half of the mattress, while the center point of the mattress is held in place. By pinning the member to the frame, the center of the mattress is held against the frame even when one portion of the mattress is inclined relative to the other. This prevents or ameliorates the mattress tendency to lift off the frame when the frame pivots into an inclined position.

15 Claims, 8 Drawing Sheets

U.S. PATENT DOCUMENTS 3,659,297 A * 5/1972 Schutz ..... 5/655
3,787,909 A * 1/1974 Johnson ..... 52/578
3,848,278 A * 11/1974 Propst ..... 5/603
4,003,704 A * 1/1977 Zurolo et al. ..... 5/617
4,225,988 A * 10/1980 Cary et al. ..... 5/607
4,287,620 A * 9/1981 Zur ..... 5/608
4,316,298 A * 2/1982 Russo et al. ..... 5/722
4,326,309 A * 4/1982 Flaum ..... 5/723
4,336,621 A * 6/1982 Schwartz et al. ..... 5/722
4,429,427 A * 2/1984 Sklar ..... 5/718
4,639,952 A * 2/1987 Kensinger ..... 5/691
4,726,083 A * 2/1988 Hoshall ..... 5/411
4,782,540 A * 11/1988 Parker ..... 5/249
4,899,404 A * 2/1990 Galumbeck ..... 5/722
4,989,281 A * 2/1991 Christensen ..... 5/118
4,993,129 A * 2/1991 Underwood et al. ..... 5/617
5,400,448 A * 3/1995 Zwickey ..... 5/691
5,568,664 A * 10/1996 Lin ..... 5/652
5,791,001 A 8/1998 Wang
5,860,174 A * 1/1999 Failor ..... 5/723
6,243,897 B1 * 6/2001 Sumiya ..... 5/610
6,263,528 B1 * 7/2001 Husler ..... 5/737
6,276,011 B1 * 8/2001 Antinori ..... 5/617
6,282,735 B1 * 9/2001 Stolpmann et al. ..... 5/606
6,295,676 B1 * 10/2001 Warner ..... 5/720
6,684,436 B1 * 2/2004 Lovelace ..... 5/722
2004/0103476 A1 * 6/2004 Barcesat ..... 5/617

* cited by examiner

MATTRESS WITH PIVOTING MEMBER ATTACHED TO ADJUSTABLE BED FRAME

REFERENCE TO RELATED APPLICATIONS

This Application claims priority to U.S. Provisional Application Ser. No. 60/414,189, entitled Mattress for Adjustable Bed, the contents of which are incorporated by reference herein.

FIELD OF THE INVENTION

This invention relates to mattresses and more particularly to mattresses for use with adjustable beds that pivot between a horizontal orientation and a reclined orientation.

BACKGROUND OF THE INVENTION

Adjustable beds offer the advantage of allowing a user to orient themselves between a horizontal position and an inclined position. Typically the adjustable bed comprises a motorized frame that has a pivot joint so that one portion of the frame can move relative to the other portion of the frame. A motor rotates the movable portion of the frame about the pivot point, causing the frame to move into an inclined position. A conventional mattress is typically placed on the frame and the mattress is sufficiently resilient and flexible to bend as the frame inclines and declines.

Although adjustable beds work well and are very common in certain environments, such as hospital rooms, certain issues have slowed their adoption in other environments. One particular problem is that the resiliency of the conventional mattress tends to return the mattress to its flat orientation whenever the user's weight is taken off the mattress. Thus, each time the user exits a bed when the bed is inclined, the mattress tries to return to its original shape. This causes the mattress to pull away from the frame so that the center of the mattress is lifted off the frame. The result is unsightly and annoying as the lifting pulls the covers off the bed and throws any reading materials or other objects onto the floor. Moreover, King size mattresses can partially lift off the frame when even one user exits the bed. This causes the remaining user discomfort as the mattress begins to rise up off the frame and over the user, causing the user to feel like they are sitting in a hole. Unsurprisingly, adjustable bed users find these issues to be very undesirable drawbacks.

Solutions to this problem have included using specially designed mattresses that have multiple segments that correspond to the pivot points of the bed frame. Thus, when the frame pivots, the mattress pivots as well and there is no tendency for the mattress to return to its original shape when the user takes their weight off the mattress. Although these mattresses can work well, they are typically less comfortable than a conventional single-segment mattress and often wear out at the pivot points.

Thus there is a need in the art for improved mattresses that can be used with adjustable beds and that reduce or eliminate the tendency to lift off the frame when the user exits the bed.

SUMMARY OF THE INVENTION

The systems and methods described herein include improved mattresses and adjustable beds adapted to work with these mattresses. Additionally, the invention encompasses methods for manufacturing mattresses and adjustable beds.

More particularly, the invention includes, among other things, mattresses that have a point of attachment to an adjustable bed frame, where the point of attachment provides a pivot point about which the mattress can pivot when rising to an inclined position. In one embodiment the mattress has a pivoting member extending transversely through the mattress. The pivoting member, in one embodiment, extends transversely through the mattress and provides a pivot point about which one portion of the mattress can pivot in relation to another portion of the mattress. In one embodiment the pivoting member comprises an attachment bar, such as a metal rod that extends through the mattress and outwardly from each side of the mattress. The outwardly extending portions of the pivoting member can be mounted to a frame to thereby pin the pivoting member in place. By placing the member about midway through the mattress, one half of the mattress can pivot relative to the other half of the mattress, while the center point of the mattress is held in place. Moreover, by pinning the member to the frame, the center of the mattress is held against the frame even when one portion of the mattress is relative to the other. As will be described below, this prevents or ameliorates the mattress' tendency to lift off the frame when the frame pivots into an inclined position.

More particularly, the systems and methods described herein include an adjustable bed mattress that comprises a mattress which has a sleeping surface and has a pivoting member that is attached to the mattress where the pivoting member is adapted to be secured to an adjustable bed frame. Optionally this adjustable mattress may have a pivoting member that includes a bar which extends transversely through the mattress for securing the mattress to the bed frame. In a further optional embodiment, the bar may be a metal rod that can have a clamp that is attached to it and the clamp is designed to secure to the adjustable bed frame.

In a further embodiment the pivoting member is a point of attachment that is located on the bottom surface of the mattress and positioned between the sides of the mattress. This point of attachment is designed to be secured to the bed frame. The point of attachment can be a clamp, it can be a rod, it can be a sash, a piece of VELCRO™ material, a fabric grommet forming one or more sleeves, or any other attachment mechanism than can be used for securing a portion of the mattress to an adjustable bed frame or to an adjustable foundation.

In a further embodiment, the systems and methods described herein include clamps that are designed to clamp onto the welt of a mattress. In this way, the clamps can clamp onto the welt of the mattress and secure the mattress to the bed frame in a manner that thereby provides a pivot point for the mattress.

In these systems, the mattress can be a one-sided mattress, a two-sided mattress, a mattress having a foam core, an air mattress, a water mattress, a mattress having a Marshall spring assembly, an open coil spring assembly, a foam inner core, a foam inner core having springs inserted therein, or any other suitable type of mattress.

In a further embodiment, the systems and methods described herein include adjustable beds that are adapted for receiving an adjustable mattress according to the invention. In one embodiment, such adjustable beds include bed frames having attachment points on either side of the bed frame for the purpose of securing the bed frame to an attachment point located on the mattress.

In yet another embodiment, the systems and methods described herein include methods for manufacturing mattress according to the invention; including mattresses that have an attachment point located on at least one side of the mattress, such as the non-sleeping side of a one-sided mattress.

As will be further understood, the invention includes adjustable beds that have a frame adapted for gripping the pivoting member extending through the mattress. In one embodiment, the adjustable bed includes a bed frame that has grommets through which the pivoting member can be fitted. The grommets act to fix the pivoting member in place and against the bed frame.

The invention will further be understood to include mattress and frame bed sets and methods for manufacturing beds and mattresses.

BRIEF DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATED EMBODIMENTS

To provide an overall understanding of the invention, certain illustrative embodiments will now be described, including a mattress that includes a pivoting member that extends transversely through the mattress and that can be fixed in place against a bed frame. However, it will be understood by one of ordinary skill in the art that the systems and methods described herein can be adapted and modified and applied in other manners and in other applications and that such other additions, modifications and uses will not depart from the scope hereof.

Figure 1:
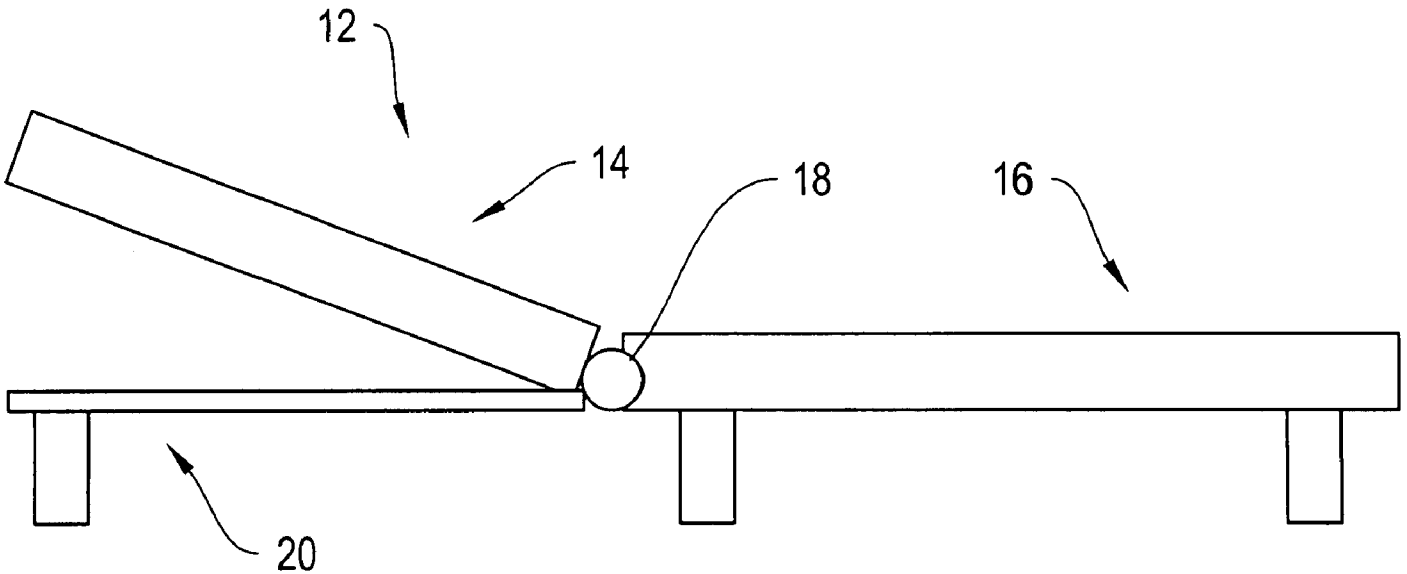
FIG. 1 illustrates an adjustable bed frame in the prior art.

FIG. 1 depicts an example of a bed frame for the adjustable bed 10 that illustrates the types of adjustable beds available in the prior art. As depicted in FIG. 1, the adjustable bed 10 includes an articulated frame 12 that has an upper portion 14, lower portion 16 and pivot joint 18. As further depicted the frame 12 also includes a floor support 20. As used in this application, the term "articulated frame" or "adjustable bed frame" shall include those articulated frames or adjustable bed frames which may have an articulated or single-segment or multi-segment foundation located thereon or attached thereto, as well as such types of adjustable foundations.

The adjustable bed 10 may include an electric motor that is capable of pivoting the upper portion 14 from a horizontal position to an inclined position as depicted in FIG. 1. Although, FIG. 1 depicts an adjustable bed 10 that has a single pivot joint 18, it will be understood by those of skill in the art that in other embodiments the adjustable bed 10 may have additional pivot joints disposed at other locations along the mattress to allow the bed to adjust in other ways, such as by allowing a user to raise or lower the foot of the bed 10 or to raise and lower the very top of the bed that provides head support to the user. The invention as described herein may be modified to accommodate any of type of adjustable bed by providing additional pivot members that correspond to the additional pivot joints within the bed frame.

Figure 2:
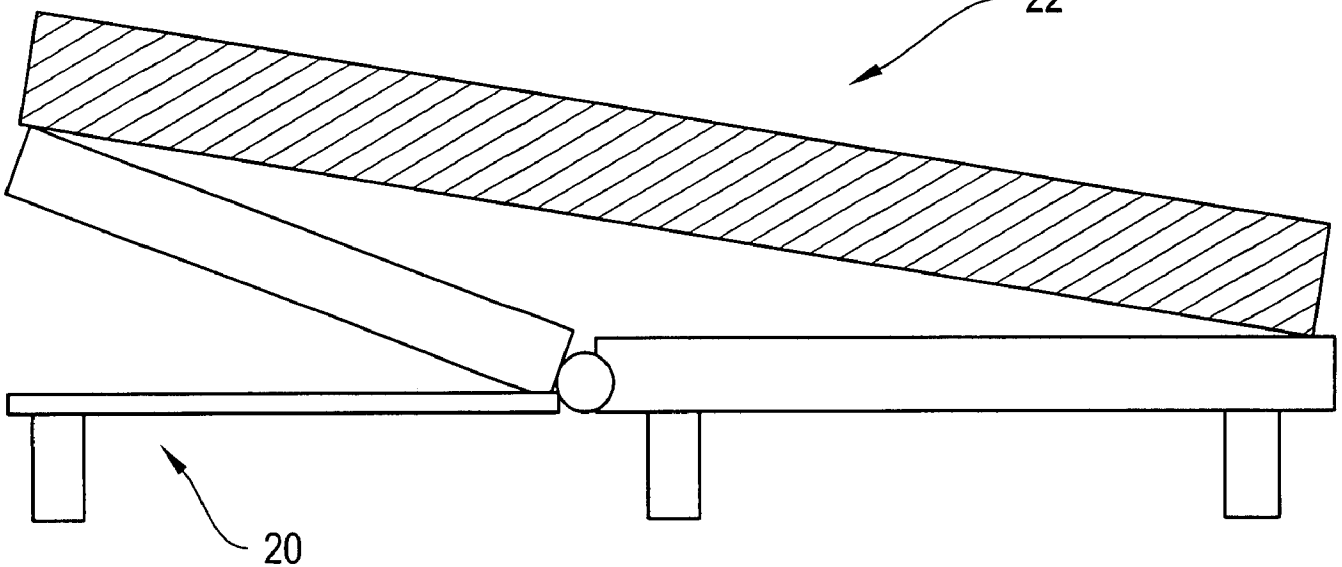
FIG. 2 depicts the adjustable bed of FIG. 1 with a conventional mattress placed thereon.

FIG. 2 depicts the adjustable bed frame 12 of FIG. 1 with a conventional mattress 22 disposed thereon. The mattress 22 can lay flat on top of the bed 10 when the bed 10 is in a horizontal position (not shown in FIG. 2). Once the bed 10 is adjusted so that its upper portion 14 is inclined relative to the lower portion 16, the conventional mattress 22 has a tendency to lift off and away from the bed frame. This tendency is particularly strong once the user has left the bed and no weight is present to hold the mattress 22 against the bed frame 12.

Figure 3:
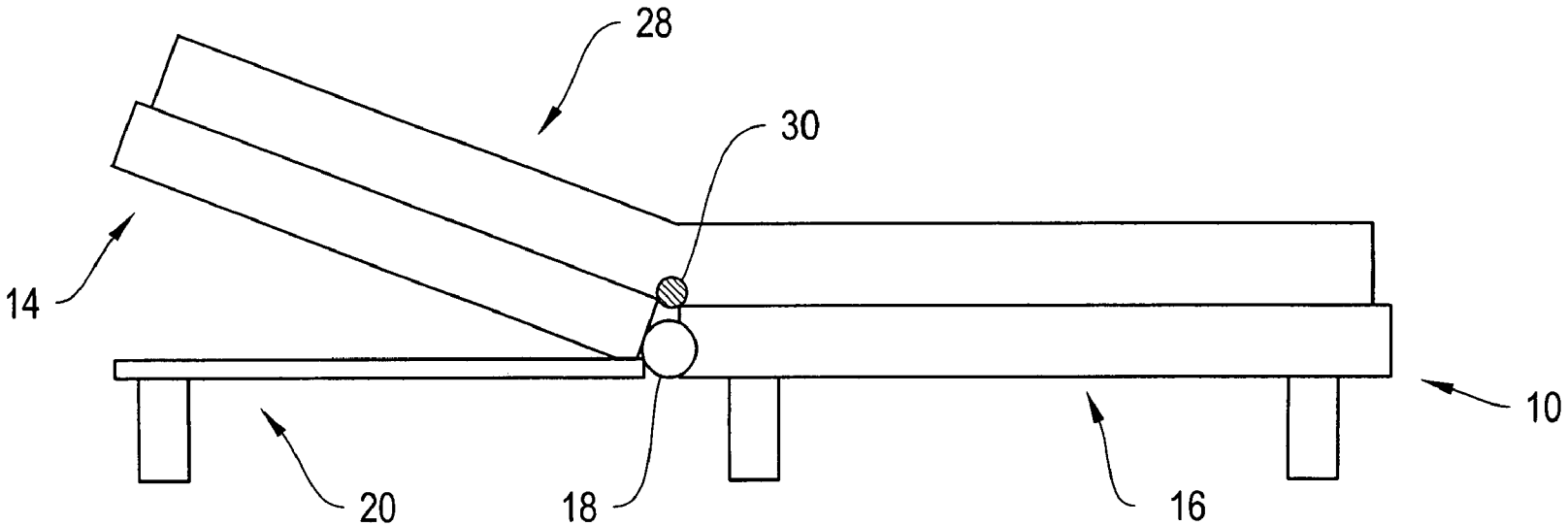
FIG. 3 illustrates one embodiment of a mattress according to the invention.

FIG. 3 depicts the adjustable bed frame 12 of FIG. 1 fitted with a mattress according to the invention wherein a pivoting member 30 extends through the mattress 28. The depicted mattress 28 is a one sided mattress of the type described in U.S. Pat. No. 6,408,469, the contents of which are incorporated by reference. As described therein, the mattress 28 may have a top sleeping surface, a bottom non sleeping surface, two side panels and a head panel and foot panel. As depicted in FIG. 3 the bottom non sleeping surface is placed against the bed frame 12 and the sleeping surface is left facing upwards for use. The mattress 28 may be a twin, queen, olympic queen, king, California king or any other size, and the bed frame size can correspond. Specifically, FIG. 3 depicts that the pivoting member 30 is positioned on or adjacent to a lower surface of the mattress 28 and disposed at a location that corresponds to the location of the pivot joint 18. The pivoting member 30 may be, in one embodiment, a steel rod that extends transversely through the mattress 28 and that may be fixed at one or more points to the frame of the adjustable bed 10. In one embodiment the pivoting member 30 is attached to fabric grommets that are formed as part of the adjustable bed 10. The fabric grommets hold the pivoting member 30 against the bed frame 12 preventing the mattress 28 from lifting off the bed frame when the upper portion 14 of the bed frame 12 moves into an inclined position.

Figure 5:
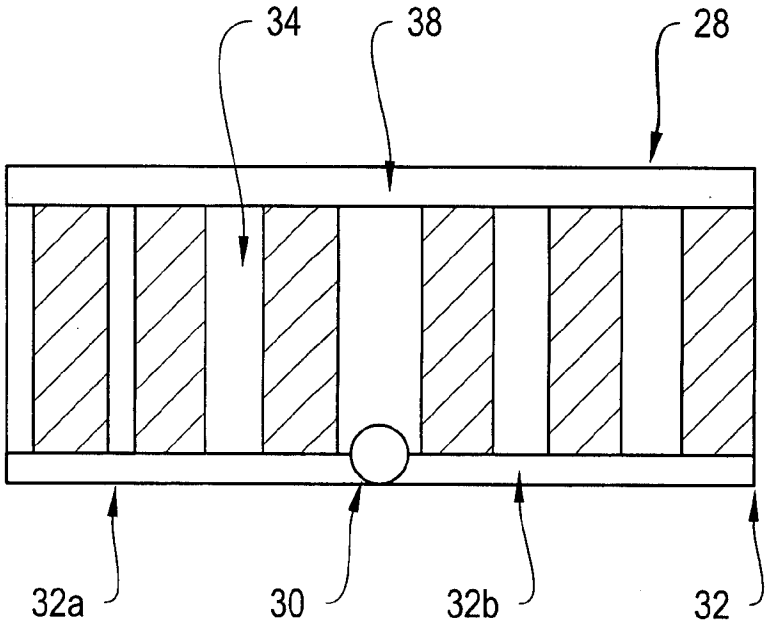
FIG. 5 depicts a cross sectional view of one mattress according to the invention.
Figure 4:
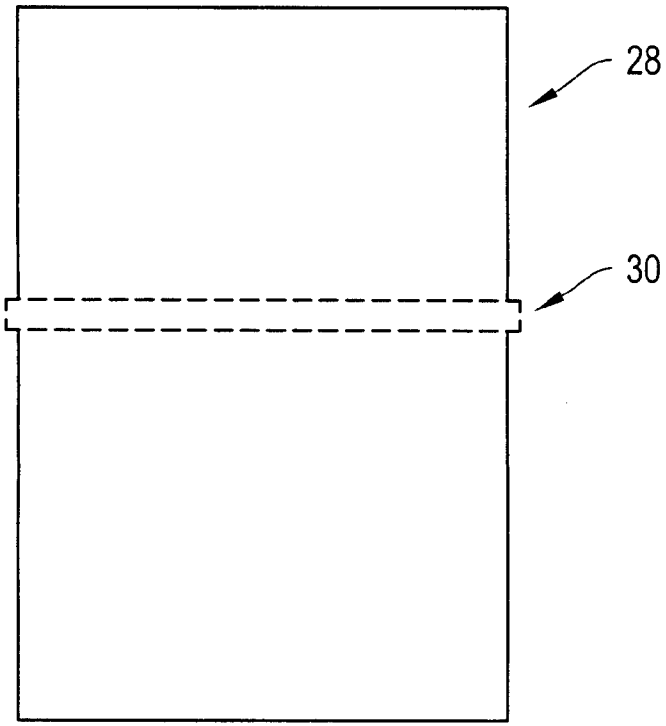
FIG. 4 illustrates a bird's eye perspective of a mattress according to the invention.

FIGS. 4 and 5 depict in more detail the structure of the mattress 28. Specifically FIG. 4 depicts a birds-eye view of the mattress 28 and shows the pivoting member 30 as extending transversely through the mattress 28. In the depicted embodiment the pivoting member is as described above a single metal rod that extends completely through the mattress. However, in other embodiments the rod may be made of plastic, fiberglass, or some other suitable material. Additionally, as described above with reference to FIG. 3, the pivoting member 30 is a solid rod that extends through the mattress 28 and that may be attached to grommets on either side of the bed frame 12. In alternative embodiments the pivoting member 30 may be formed of a VELCRO™ sash that is sewn onto the lower portion of the mattress 28 and is capable of being tied to the underside of the adjustable bed 10 for holding the lower surface of the mattress against the bed frame to thereby prevent the mattress 28 from lifting off the bed frame when the upper portion of the bed frame 14 is moved into the inclined position. Optionally, the sash may be canvas or any other suitable material; and the material used will depend upon the application at hand. In certain embodiments, the sash may be part of a sheet or slipcover that is placed over the bed or mattress and provides a length of material that can be used to tie the mattress to the bed frame 12. The sash can tie underneath the bed frame or can tie to posts or slots built into or attached to the frame. In certain embodiments, a plurality of sashes may be provided for securing the mattress to the frame at multiple locations.

FIG. 5 presents more detail of the structure of the mattress 28. Specifically, FIG. 5 shows a mattress 28 that includes a pivoting member 30 extending transversely through the mattress 28. As depicted in FIG. 5 in one embodiment the mattress is a one-sided mattress having a substantially rigid lower surface 32. The substantially rigid lower surface 32 supports a plurality of pocketed coils 34 that sit on top of the rigid surface 32. Positioned above the pocketed coils 34 is a layer of foam 38. As shown in FIG. 5, in one embodiment, the pivoting member extends through the substantially rigid surface 32. In this embodiment the substantially rigid lower surface 32 is divided into two sections. The first section, 32A, supports the upper portion of the mattress 28 and is dimensioned to correspond in size to the upper portion 14 of the adjustable bed depicted in FIG. 10. At the pivoting member 30 the rigid member 32 is divided such that a second section 32B is provided that may move relatively freely in relation to the first section 32A. In this way, the upper portion of the mattress 28 may pivot relative to the lower portion of the mattress 28 when the bed moves into an inclined position. In either case, the pivoting member 30 may be attached to the bed frame to prevent the mattress from lifting off the bed frame.

Figure 7:
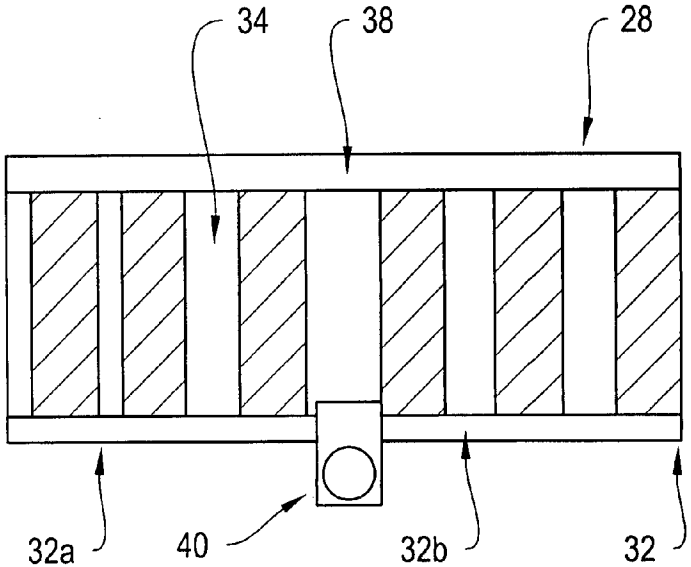
FIG. 7 depicts a cross sectional view of the alternative embodiment that employs the clamp depicted in FIG. 6.
Figure 6:
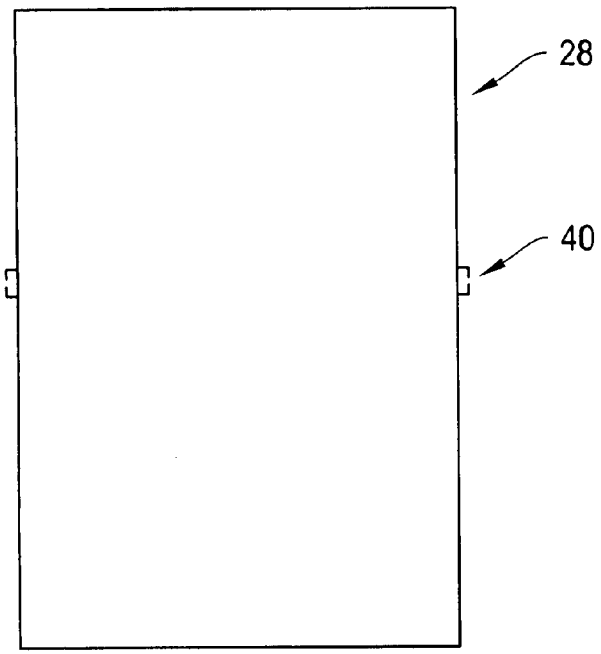
FIG. 6 depicts an alternative embodiment of the invention that employs a clamp for holding a central portion of a mattress against a foundation.

FIGS. 6 and 7 depict an alternative embodiment wherein a clamp 40 is attached at either side of the mattress 28. Specifically, FIG. 6 shows a mattress 28 that includes two clamps 40, each disposed on one side of the mattress 28 at a position, that in this illustration, is near the center of the mattress. As depicted in FIG. 6 in one embodiment the mattress is a one-sided mattress having a substantially rigid lower surface 32. The substantially rigid lower surface 32 supports a plurality of pocketed coils 34 that sit on top of the rigid surface 32. Positioned above the pocketed coils 34 is a layer of foam 38.

Figure 8:
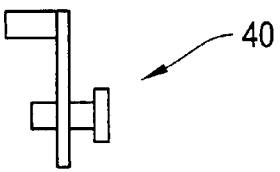
FIG. 8 depicts a side view of the clamp.

The clamp may be a metal clamp that, as shown in FIG. 7 may be attached so that the upper portion of the clamp clamps against the welt of the mattress 28. The lower portion of the clamp may clamp against the foundation, thereby securing the mattress 28 to a foundation. In an alternative embodiment, as shown in FIG. 7, the clamp may have a lower section that is bolted to the foundation. FIG. 8 depicts the clamp 40 in side view to illustrate its structure for gripping the mattress 28. The clamp may grip the welt, or secure to a lower border wire or grab the fabric on the side of the mattress. Those of skill in the art shall understand that the clamp and attachment points may be used in different ways and at different locations, and the manner and location will vary according to the application at hand. In still a further alternative embodiment, the clamp 40 may include a rod, similar to the rod of FIG. 5, that extends through the mattress 28 and joins with the clamp 40 on the opposite side of the mattress 28.

Figure 9:
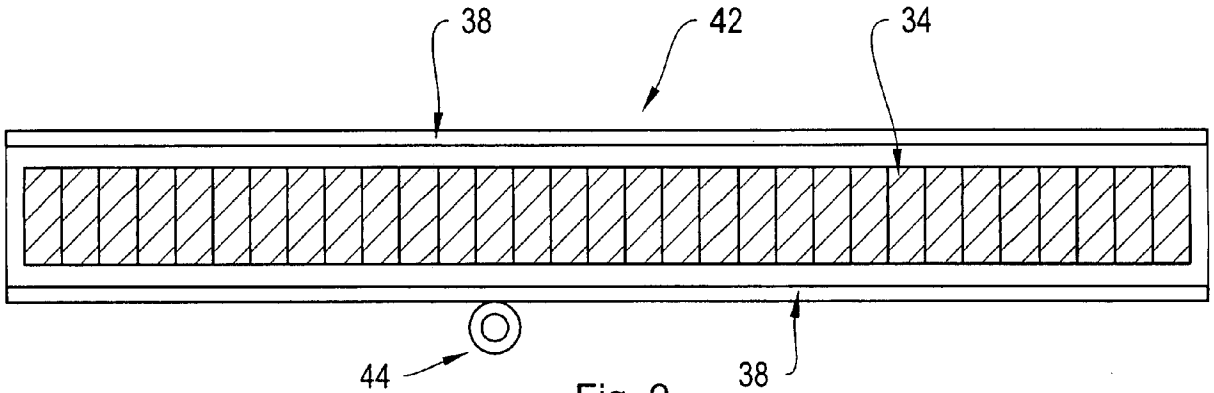
FIGS. 9 and 10 depict one embodiment of the mattress having fabric grommets.
Figure 10:
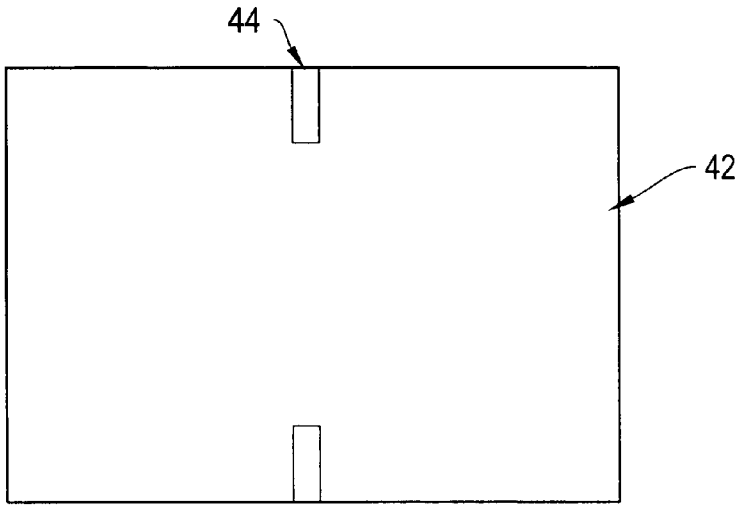
Figure 12:
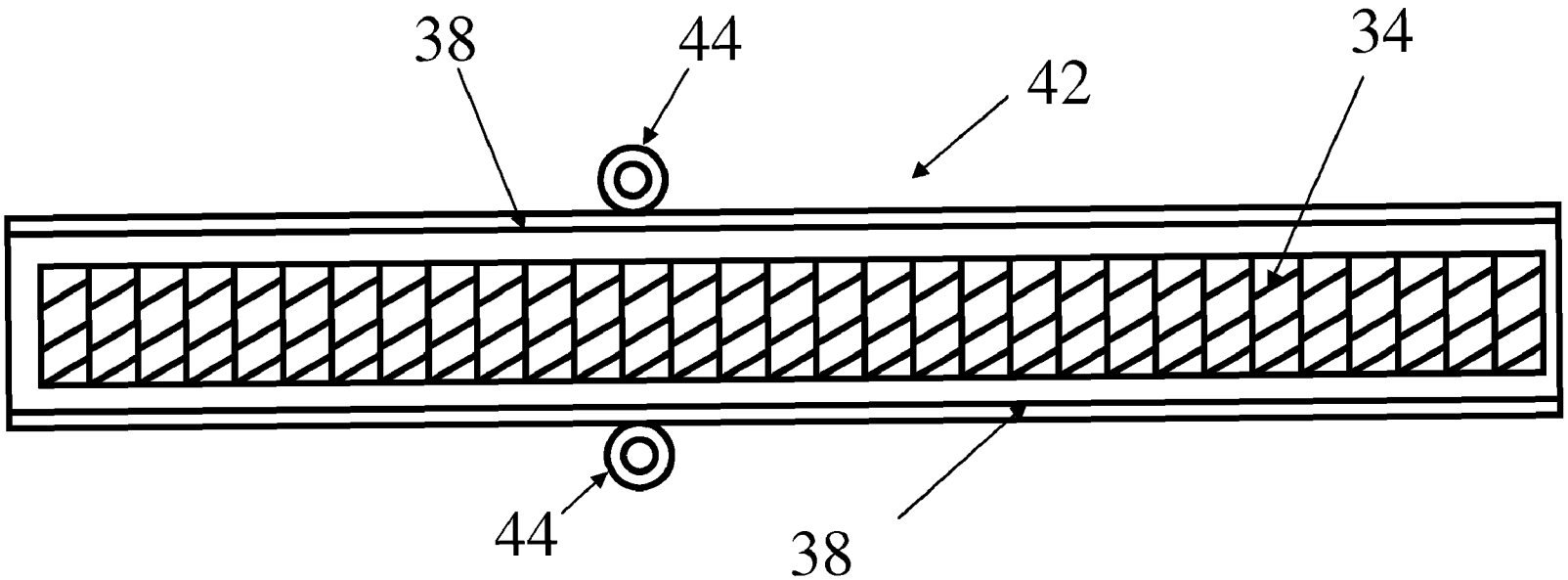
FIG. 12 depicts another embodiment of the mattress having fabric grommets.

FIGS. 9 and 10 depict pictorially the embodiment described above that includes a fabric grommet for attaching the mattress to the bed frame, or foundation. As depicted in FIG. 9, the fabric grommet 44 is disposed at one side of the mattress 42 to provide a point of attachment to the bed foundation at a point where pivoting is desired. As shown in FIG. 10 the fabric grommet 44 may be a fabric sleeve sewn onto one side of the mattress 42. The mattress 42 depicted in FIGS. 9 and 10 is a two-sided mattress. In this embodiment the fabric grommets 44 may be sewn onto both sleeping surfaces of the mattress 42, as shown in FIG. 12, allowing a user to flip the mattress when appropriate. Optionally, the fabric grommet 44 may attach to the mattress 42 by a VELCRO™ strip that joins the grommet 44 to the mattress 42. Moreover, in a further optional embodiment, the fabric sleeve grommet 44 may be part of a larger slipcover that slides over the mattress 42 as a mattress covering that may attach to the bed frame 12. In this way, a user can adapt a traditional mattress for use with an adjustable bed frame 12. Moreover, the user can flip the mattress as needed and merely needs to remove and reorient the slipcover so that the fabric grommet sleeve 44 is positioned as needed.

Figure 11:
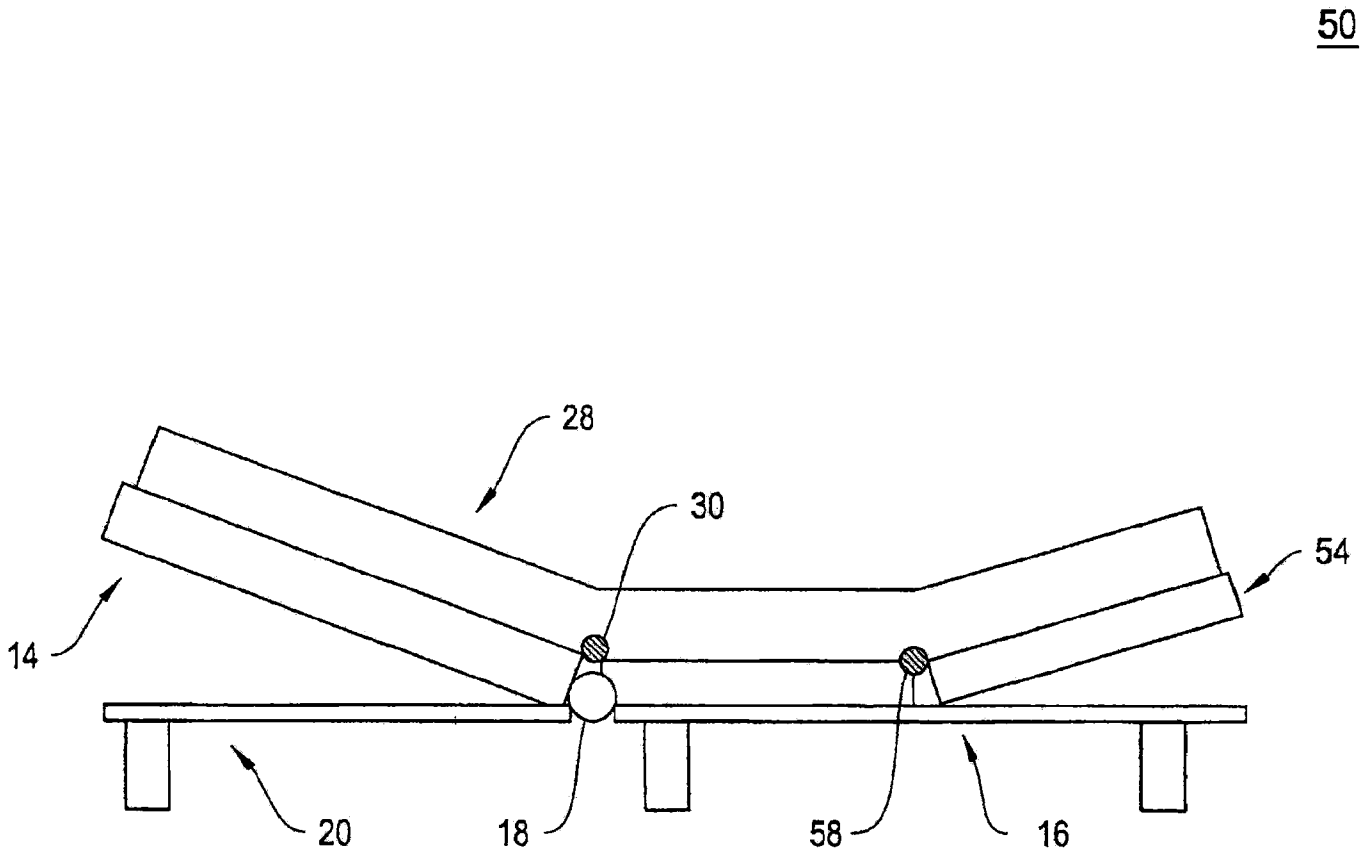
FIG. 11 depicts a mattress for use with an adjustable bed having an adjustable head and foot.

FIG. 11 depicts an embodiment discussed above wherein the adjustable bed frame 12 provides more than one pivot point, and in this illustrated case allows a head portion 14 to be elevated as well as a foot portion 54. As described above, two pivot points 30 and 58 may be provided to allow the mattress 28 to be held against the bed frame 12 when either the head or foot portions are inclined. Other pivot points may be added as desired. Additionally, as described above, the mattress may be covered by a sheet or slipcover that has multiple sash arms that can be tied to the frame 12 to secure the mattress at each location.

In another aspect, it will be understood that the invention includes adjustable beds that are adapted for supporting mattresses that have pivoting members which may be secured to the adjustable bed frame. In certain embodiments the adjustable beds include grommets that may be secured to the pivoting members for the purpose of pinning the pivoting members against the bed frame. It will further be understood that the above figures illustrate only certain embodiments of invention. For example FIG. 5 depicts a one-sided mattress adapted for use with the adjustable bed of FIG. 3. However, the invention may be adapted to be employed with convention two-sided mattresses, as well as mattresses that include pocketed coils or inner cores of wire spring assemblies, or foam mattresses or foam mattresses having coil inserts. Additionally, it will be understood that the mattress 28 has been described above as having a solid rod that extends transversely through the mattress 28. However, it will be understood to those who are skilled in the art that the rod may comprise two sections with each section extending only partway through the mattress. In further optional embodiments, the mattress may have a single point of attachment, such as one that is centrally located, and provides a center point in which the mattress 28 may attach to the bed 10. Other embodiments will be apparent to those of skill in the art. Accordingly, the invention is not limited to the systems and methods depicted herein, but may include substitution, additions and modifications as will be apparent to those of skill in the art. Thus, the invention is to be understood by reference to the claims below and interpreted as broadly as allowed by law.

What is claimed is:

1. An adjustable bed assembly comprising:

an adjustable bed frame having an attachment bar, and configured to pivot about the attachment bar;

a mattress having a substantially rectangular sleeping surface disposed on the adjustable bed frame, wherein the mattress is configured to pivot about an axis; and a pivoting member attached to an exterior portion of a major surface of said mattress, and configured as a tubular sleeve having a first opening and a second opening and extending outwardly from the major surface, wherein the axis is normal to the first opening and the second opening, said pivoting member receives the attachment bar along the axis through the first opening and the second opening for attachment to the adjustable bed frame.

2. The adjustable bed assembly of claim 1, wherein said pivoting member is disposed on a surface of said mattress opposite the sleeping surface and between two side surfaces of said mattress.

3. The adjustable bed assembly of claim 1, wherein said tubular sleeve comprises a fabric grommet.

4. The adjustable bed mattress of claim 1, wherein said mattress is a one-sided mattress having a substantially rigid lower surface.

5. The adjustable bed mattress of claim 4, wherein said lower surface is divided into at least two sections, which are positioned on opposite sides of said pivoting member.

6. The adjustable bed assembly of claim 1, wherein the pivoting member is releasably attached to the mattress.

7. The adjustable bed assembly of claim 6, wherein the pivoting member is releasably attached to the mattress by a hook-and-loop fastener.

8. The adjustable bed assembly of claim 1, wherein the mattress has a uniform thickness.

9. The adjustable bed assembly of claim 1, wherein the mattress comprises coil springs.

10. The adjustable bed assembly of claim 1, wherein the mattress comprises pocketed springs.

11. The adjustable bed assembly of claim 2, wherein the pivoting member comprises a plurality of tubular sleeves arranged between two side surfaces of the mattress.

12. The adjustable bed assembly of claim 1, wherein the mattress is a two-sided mattress having two major substantially rectangular surfaces, each adapted to form a sleeping surface; and pivoting members configured as a tubular sleeve and attached to each of the major surfaces of said mattress, said pivoting members adapted to receive an attachment bar for attachment to an adjustable bed frame.

13. The adjustable bed assembly of claim 12, wherein said mattress is reversible.

14. The adjustable bed mattress of claim 1, comprising at least two pivoting members spaced in a longitudinal direction of the mattress, each of the at least two spaced pivoting members adapted to receive a corresponding attachment bar for attachment to the adjustable bed frame.

15. A method of using a mattress with an adjustable bed frame in an adjustable bed assembly comprising:

providing an adjustable bed frame having an attachment bar, and configured to pivot about the attachment bar;

providing a mattress having a substantially rectangular sleeping surface, wherein the mattress is configured to pivot about an axis;

attaching a pivoting member to an exterior portion of a major surface of the mattress, the pivoting member configured as a tubular sleeve extending outwardly from the major surface; and attaching the mattress to the adjustable bed frame such that the pivoting member receives the attachment bar.

* * * * *